US005559681A

United States Patent [19]

Duarte

[11] Patent Number: 5,559,681

[45] Date of Patent: Sep. 24, 1996

[54] FLEXIBLE, SELF-ADHESIVE, MODULAR LIGHTING SYSTEM

[75] Inventor: Noah G. Duarte, Merrimack, N.H.

[73] Assignee: CNC Automation, Inc., Amherst, N.H.

[21] Appl. No.: 242,293

[22] Filed: May 13, 1994

[51] Int. Cl.[6] ..... F21P 1/02

[52] U.S. Cl. ..... 362/252; 362/237; 362/244; 362/251; 362/800; 362/806; 439/210

[58] Field of Search ..... 362/237, 249–252, 362/800, 806–808, 244, 236, 457, 458, 151, 152; 439/210, 641, 648

[56] References Cited

U.S. PATENT DOCUMENTS

| | | | |
|---|---|---|---|
| 2,414,866 | 1/1947 | Glaser | 439/648 |
| 3,868,671 | 2/1975 | Maguire et al. | 362/251 |
| 3,894,225 | 7/1975 | Chao | 362/249 |
| 4,173,035 | 10/1979 | Hoyt | 362/252 |
| 4,259,709 | 3/1981 | Eddings | 362/231 |
| 4,390,097 | 6/1983 | Klomp | 206/418 |
| 4,463,411 | 7/1984 | Proctor | 362/61 |
| 4,554,419 | 11/1985 | King | 200/5 A |
| 4,570,206 | 2/1986 | Deutsch | 362/800 |
| 4,751,627 | 6/1988 | Usher | 362/250 |
| 4,761,720 | 8/1988 | Solow | 362/249 |
| 4,896,251 | 1/1990 | Fasel | 362/80.1 |
| 4,909,189 | 3/1990 | Minotti | 119/106 |
| 5,019,748 | 5/1991 | Appelberg | 315/169.3 |
| 5,057,981 | 10/1991 | Bowen et al. | 362/249 |
| 5,128,843 | 7/1992 | Guritz | 362/800 |
| 5,193,895 | 3/1993 | Naruke et al. | 362/249 |
| 5,202,168 | 4/1993 | Turner | 428/40 |
| 5,337,225 | 8/1994 | Brookman | 362/457 |

OTHER PUBLICATIONS

Capitol Lighting Catalog, 1 page, Yonkers, New York no date.

Flex–A–Lite Catalog, 1 page, Yonkers, New York no date.

Laurel Lites Catalog, 7 pages, 1989, Yonkers, New York.

*Primary Examiner*—Denise L. Gromada

*Assistant Examiner*—Alan B. Cariaso

*Attorney, Agent, or Firm*—Daniel J. Bourque; Kevin J. Carroll

[57] ABSTRACT

A flexible, self-adhesive, lighting system includes a continuous length of flexible, self-adhesive, light emissive material, cuttable into segments of light emissive material, each segment including a plurality of light emitting diodes serving as light emissive devices. The segments are electrically coupled by different shaped couplers, for forming a variety of configurations of light emissive material, and further coupled to a source of power. Each coupler includes at least two electrical conductors for conducting power from one segment of light emissive material to a coupled segment or a source of power. Each of the light emissive devices may be covered by one clear or colored lens. Alternatively, multiple light emissive devices, of the same or different color, may be covered by one lens. Further, steady or intermittent power from a power control unit may be supplied to each light emissive device for providing different lighting sequences and colors.

14 Claims, 7 Drawing Sheets

FLEXIBLE, SELF-ADHESIVE, MODULAR LIGHTING SYSTEM

FIELD OF THE INVENTION

This invention relates to a lighting system, and more particularly, to a flexible, self-adhesive, light emissive material, including a plurality of light emissive devices, cuttable into segments which can be interconnected to form lighting system of any size and shape.

BACKGROUND OF THE INVENTION

Lighting systems are presently used comprising an individual or a group of lights for illuminating a large variety of objects. Typically, the lights are arranged in a linear row for decorative, advertising or safety purposes. The row of lights may be attached to a wire string such as the string of lights seen at used car lots or used for Christmas decorating. However, a string of lights of this type is limited in usefulness due to the difficulty of attaching the string of lights to various structures.

Strips of lights may also be used wherein they are attached to surfaces such as doorways and windows for decorative or safety purposes. Additionally, billboard signs often use strips of lights to illuminate the billboard signs at night. However, these lighting systems are limited in that these types of lights often are inflexible in their design and often require permanent mounting to the attached structure.

Several prior art attempts at providing flexible light strips exist, although all suffer from significant drawbacks. For example, a flexible lighting product known as flex-a-light available from Capitol Lighting Products is circular in cross section and accordingly is difficult, if not impossible, to adhere directly to a surface such as a sign, window, door frame or other surface to which the lighting product is desire to be adhered. Additionally, and most importantly, the product must be cut exactly at predetermined intervals or regions in order to avoid damaging a light emitting device or the circuitry interconnecting each of the light emitting devices.

Another product available from Capitol Lighting Products and well known in the prior art is Belt Lighting which includes a flat piece of conductive material on which are installed lamp sockets into which are inserted small bulbs. This product suffers from significant drawbacks in that the lamps are exposed to the elements and that they are very susceptible to damage by wind, water, etc. Additionally, the belt light must be adhered to a surface using an externally applied fastening mechanism such as tape, epoxy or a mounting device inserted through holes in the strip. Accordingly, these limitations greatly limit the useability of this product.

Lastly, and most importantly, both prior art products disclosed utilize lighting devices drawing significant current which greatly limits the length of available strips of lighting material to approximately thirty feet.

Accordingly, what is needed is a nearly unlimited length of flexible, self-adhesive light elements which can be mounted easily, in any desired form or design, by cutting or shaping the flexible length of lights, for decorative, advertising and safety purposes. Further, a length of lights is needed which may provide a constant source of light or a flashing or intermittent source of light.

SUMMARY OF THE INVENTION

This invention features a flexible, self-adhesive, lighting system including a continuous length of flexible, self-adhesive, light emissive material, cuttable at any location, including at or on a light emissive device into at least a first segment, and at least a first light emissive material coupler, for electrically coupling the segment of light emissive material to a source of electrical power. Further, each segment of light emissive material includes an adhesive strip coupled to the bottom surface of each segment.

In one embodiment, the continuous length of self-adhesive light emissive material can be cut into at least first and second segments, each segment of light emissive material including a plurality of electrically coupled light emissive devices. The electrically coupled light emissive devices include light emitting diodes.

A further feature of the present invention is that each segment of light emissive material includes at least first and second electrical conductors for conducting electrical power from the source of electrical power to each electrically coupled light emissive device. The electrical conductors may comprise either a copper strip or a strip of braided metallic fabric.

This system can also be configured in a multitude of shapes and configurations by utilizing a plurality of the light emissive material couplers. The couplers may couple a first segment to a second segment of light emissive material, or different shaped couplers may be used to form different designs or shapes of light emissive material. The various configurations for the couplers include "tee" shaped couplers, "Y" shaped couplers and right angle couplers.

Each of the light emissive material couplers includes at least a first and second interconnecting electrical conductor, for providing a continuous flow of electrical power from the electrical conductors of a first segment to the electrical conductors of a second light emissive segment or a source of electrical power. Further, each of the couplers includes a plurality of conductor engaging elements, for engaging the electrical conductors of each interconnected segment. The couplers further include a locking element to securely interconnect each segment within each coupler.

A further feature of the present invention is an electrical power control unit coupled between the source of electrical power and the segments of light emissive material, for providing constant or controlled intermittent power to each of the electrically coupled light emissive devices. Further, the electrical power control unit includes a lighting sequence controller, for controlling the duration of lighting sequences of each of the light emissive devices. The lighting sequence controller may provide for flash, intermittent flash, twinkle, fade on/off, or chase lighting sequences.

Each of the light emissive devices included with each least of light emissive material is covered by either a clear lens or a colored lens. The lens may cover one light emissive device or a multiple number of light emissive devices, for increasing the brightness of the light emitted. Further, different colors of light emissive devices may be covered by one lens, for producing different colors of emitted light in which case the electrical control unit includes a color selector, for selecting the color of light emitted by the lighting system.

A further feature of the present invention is a method for providing a flexible, self-adhesive, modular lighting system including the steps of providing a continuous length of flexible, self-adhesive, light emissive material which includes a plurality of electrically coupled light emissive devices. The continuous length of light emissive material is cut into at least one segment of light emissive material and the segment joined to a power source in a predetermined manner by at least one electrical coupler. The segments are joined to a source of electrical power, for providing electrical power to the plurality of light emissive devices.

BRIEF DESCRIPTION OF THE FIGURES

These and other features and advantages of the present invention will be better understood by reading the following detailed description, taken together with the drawings wherein.

DETAILED DESCRIPTION OF THE PREFERRED EMBODIMENT

Figure 1:
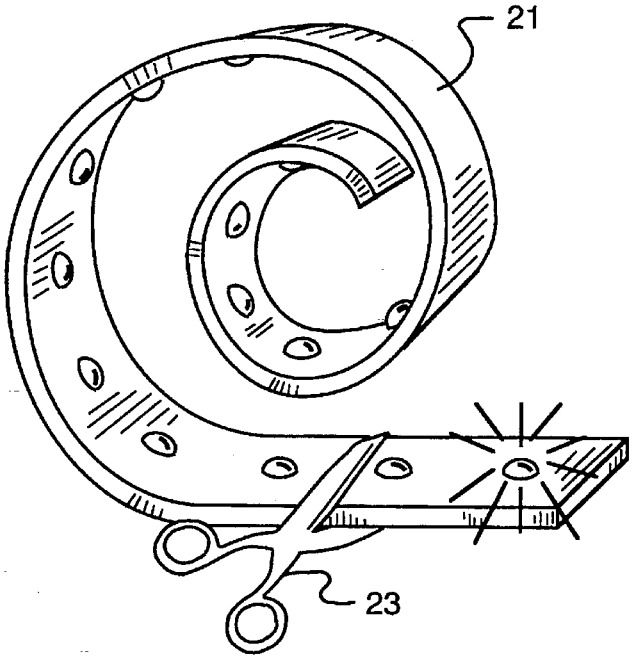
FIG. 1 is a perspective view of a roll of flexible, self-adhesive, light emissive material of the present invention.
Figure 2:
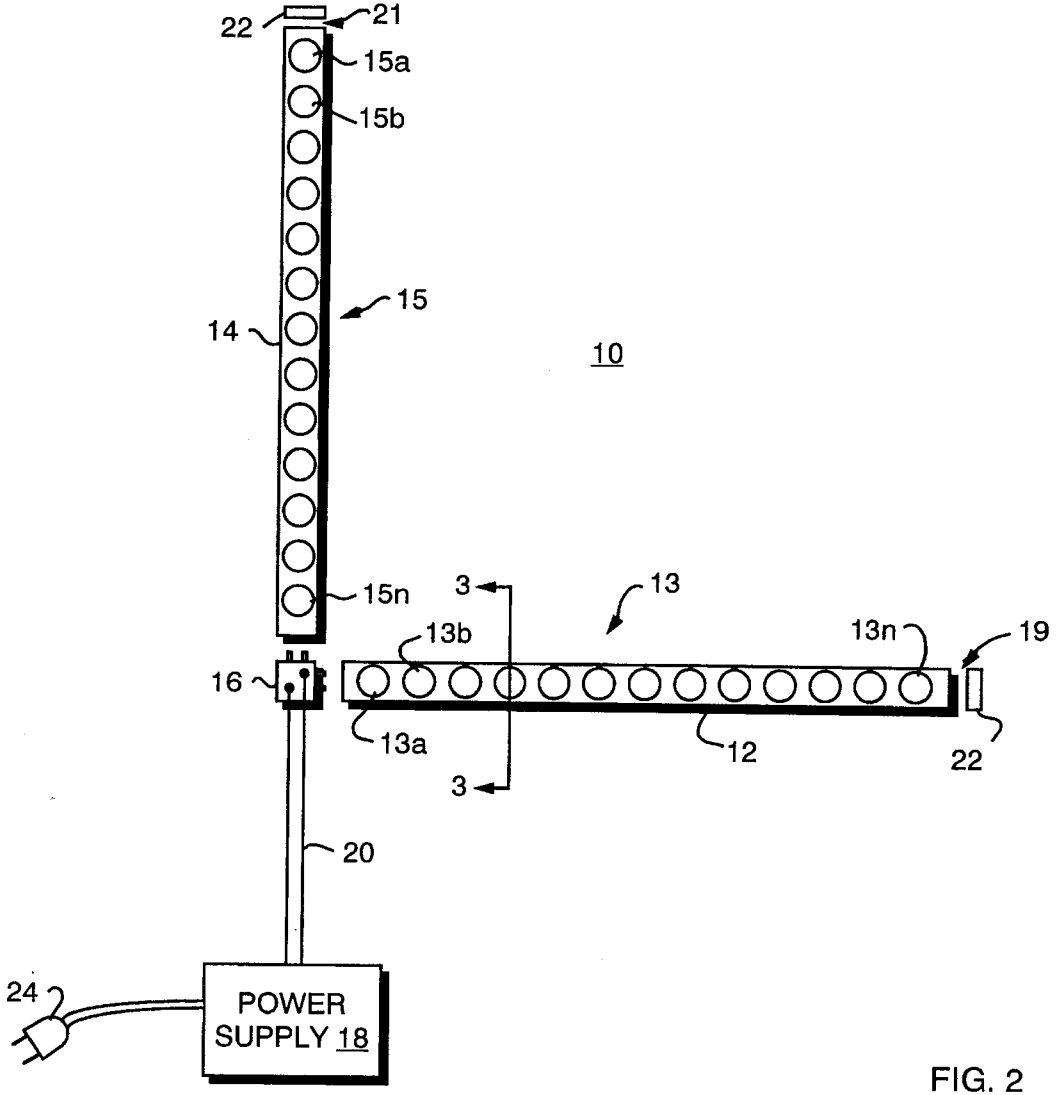
FIG. 2 is a diagrammatical representation of lighting system in accordance with the present invention.

The flexible, self-adhesive, modular lighting system 10, FIG. 2, comprises at least a first segment of light emissive material 12 cut from a continuous length or roll 21, FIG. 1, of flexible, self-adhesive light emissive material utilizing scissors 23, knife, or other similar means. A second segment 14 may also, for example, be cut from roll 21.

First segment 12 includes a plurality of electrically coupled light emissive element 13*a*–13*n*, generally denoted as 13. Similarly, second segment 14, if provided, includes a plurality of electrically coupled light emissive elements 15*a*–15*n*, generally denoted as 15. End caps 22 may be provided which attach to the outer ends of first and second segments of light emissive material 12, 14 to make the outer ends more attractive and to prevent moisture or other harmful elements from penetrating the segments of light emissive material.

A light emissive material coupler 16 couples first segment 12 and second segment 14 together and couples first and second segments 12, 14 to a source of electrical power 1.8 by means of electrical wires or cable 20. The source of electrical power 18 may be a low powered AC/DC converter receiving its source of AC power by means of plug 24, and for providing low power 12 to 24 volt output to the lighting system.

Figure 3:
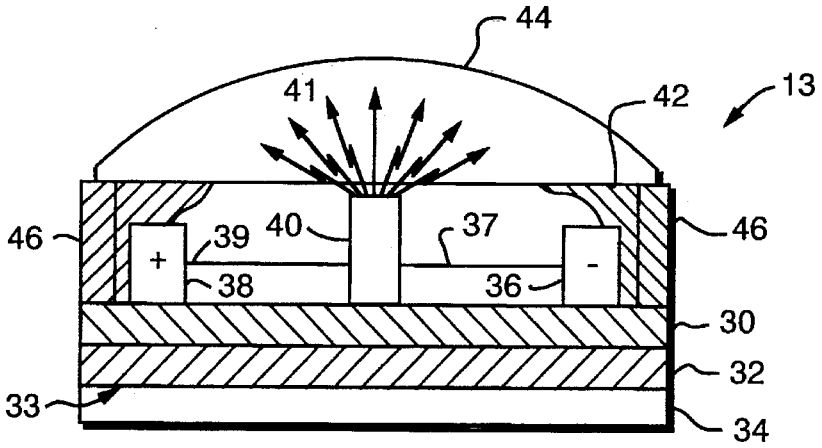
FIG. 3 is a cross-sectional view of a light emissive device of FIG. 1, shown coupled to the segment of light emissive material.

Referring to FIG. 3, a cross sectional view of a typical light emissive element 13, 15 from FIG. 2 is shown in greater detail. At least one light emissive device 40, typically a light emitting diode, but also including a lamp or fiber optic light emitter, is coupled to a sub-laminate layer 30 preferably a plastic or acrylic sheet, on which is disposed at least two electrical conductors 36, 38. Light emitting device 40 is shown coupled to the positive conductor 38 by electrical lead 39 and coupled to the negative conductor 36 by electrical lead 37 Because of the low power consumption of light emitting diodes, the present invention allows segments to be many feet in length, covering distances of 1000 or more feet with a standard power source providing 1 amp of current at 1 volt.

An adhesive layer 32 such as double sided tape is coupled to the bottom surface of the sub-laminate layer 30 for attaching the segment of light emissive material to a variety of structures or surfaces. A protective sheet typically of paper material 34 attaches to the adhesive layer 32 prior to adhering the segment of light emissive material to the structure. The protective sheet 34 is removed from the adhesive layer 32 prior to attachment to expose an adhesive layer on the bottom surface 33 of adhesive layer 32.

Spacer 46 mounts to sub-laminate layer 30 made-of a flexible polymer material such that spacer 46 surrounds light emissive device 40 and may comprise a square, elliptical, or trapezoidal configuration.

A transparent, protective sheet of plastic 42, typically a sheet of mylar, is attached to the spacer 46, by means such as thermal bonding or resistance welding for covering and protecting the electrical conductors 37, 38 and the light emissive device 40. A lens 44 covers the light emitting device 40 such that light may be emitted from the light emitting device 40 in direction 41 covering a desired angle. The lens 44 may be either a clear or a colored lens depending on the desired color to be emitted, and may include a dome or a straight cover.

Figure 4:
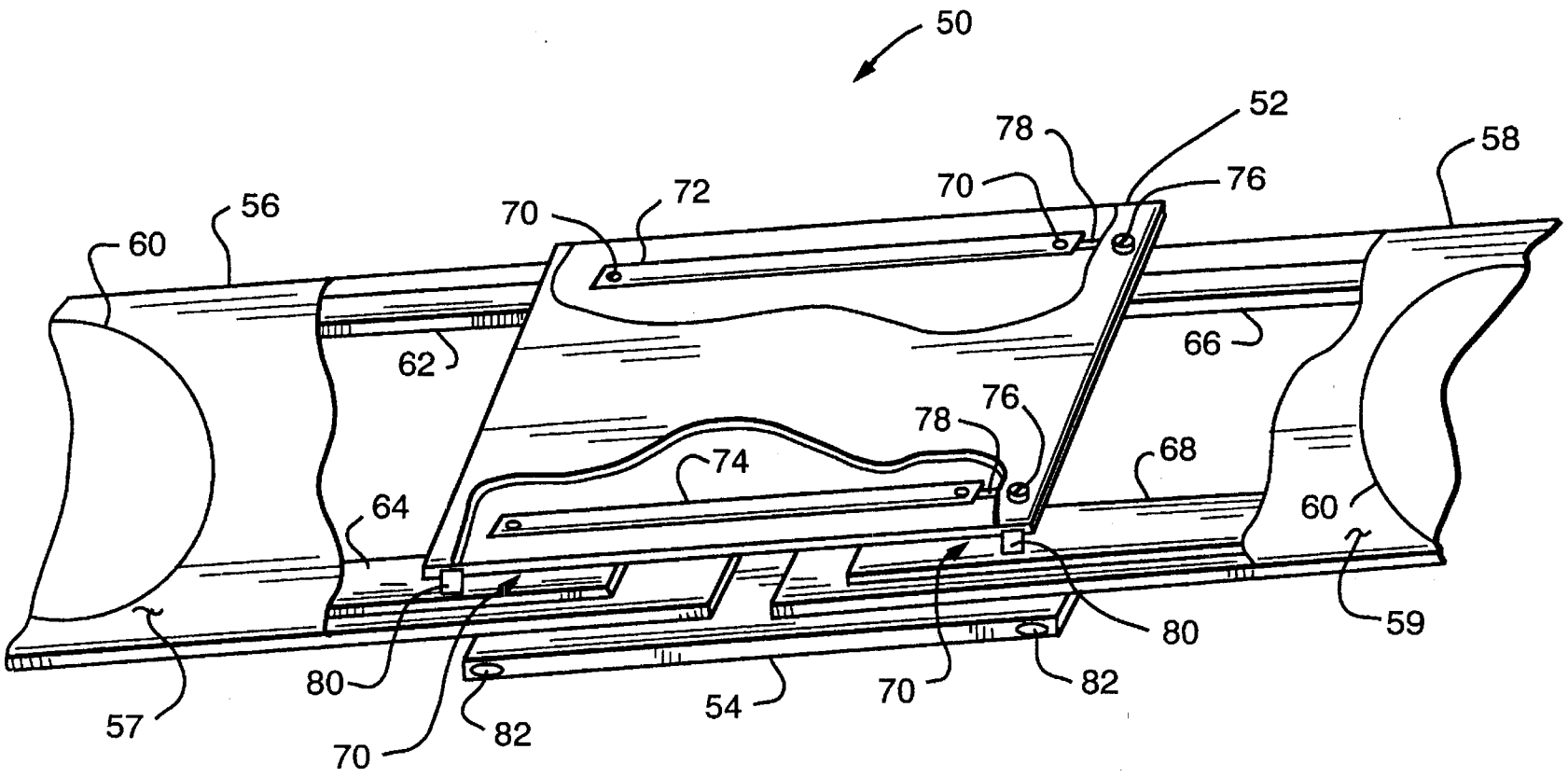
FIG. 4 is a diagrammatical representation of two segments of light emissive material coupled by a light emissive material electrical coupler.

A light emissive material coupler 50, FIG. 4, is shown electrically coupling a first segment of light emissive material 56 to a second segment of light emissive material 58. The first and second segments 56, 58 are secured between the top portion 52 and the bottom portion 54 of coupler 50. First and second interconnecting electrical conductors 72, 74 include a plurality of conductor engaging elements 70, for piercing the top mylar sheet 57, 59 and for engaging first and second electrical conductors 62, 64 of the first segment 56 and first and second electrical conductors 66, 68 of the second segment 58.

Electrical power from an external source (not shown) is provided to the plurality of light emissive elements 60 coupled to first and second segments 56, 58 by coupling an electrical wire to electrical conductive receptacles 76, such as a screw, Insulation Displacement Connector (IDC) or other similar means, on at least one coupler as well known by those skilled in the art. The electrical conductor receptacles 76 couple to first and second interconnecting electrical conductors 72, 74 by means of an electrical wire 78 or other similar means.

The top and bottom portions 52, 54 of the light emissive material coupler 50 are fastened together by means of clasp hook 80 and clasp receptacle 82, whereby when clasp hook 80 and clasp receptacle 82 are engaged, first and second segments 56, 58 are secured between top portion 52 and bottom portion 54. In the secured position, the conductor engaging elements 70 crimp onto and into first and second electrical conductors 62, 64 of the first segment 56 and first and second electrical conductors 66, 68 of the second segment 58.

Electrical contact with the conductor engaging elements 70, which are coupled to first and second interconnecting electrical conductors 72, 74 of the light emissive material coupler 50, provides a continuous flow of electrical power from the external source of electric power to each segment of light emissive material including the light emissive devices, and from a first segment to a second segment.

Figure 5A:
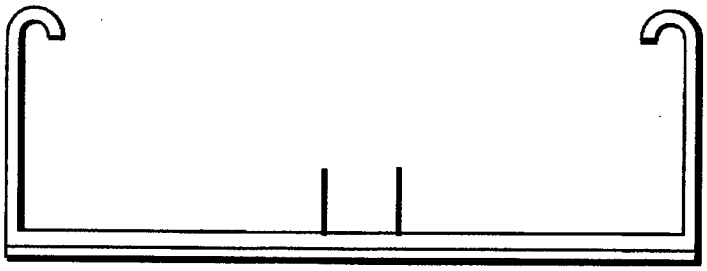
FIGS. 5A–5C are schematic representations illustrating the various uses of the light emissive material connector according to one feature of the present invention.
Figure 5B:
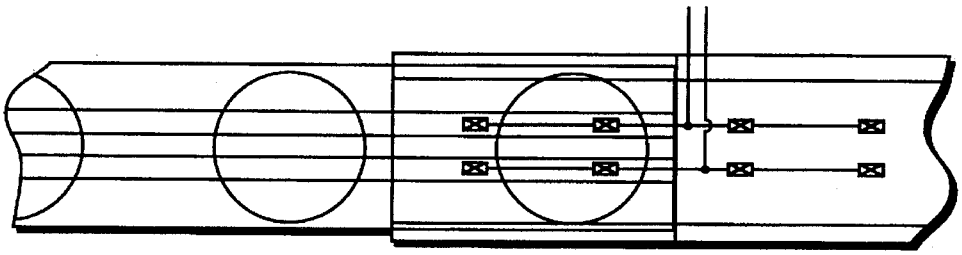
Figure 5C:
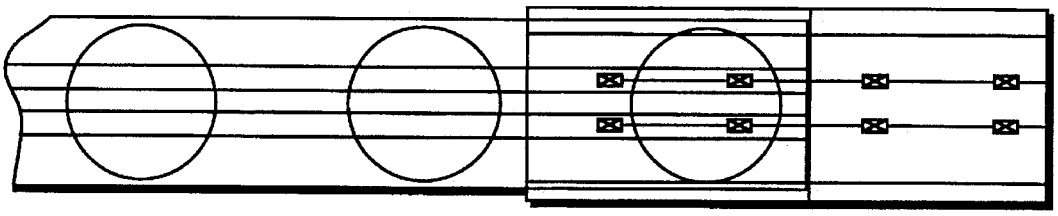

Although the light emissive material of the present invention includes an adhesive layer along the body region, the preferred embodiment of the light emissive material couplers 50, FIG. 5A of the present invention also include an adhesive layer 51 along the body region of the light emissive material coupler. Further, as shown in FIGS. 5B–5D, the light emissive material couplers of the present invention may be utilized to power a strip of light emissive material from the middle of a segment, FIG. 5B, or from the end of a segment, FIG. 5C. It is understood that other variations are considered to be within the scope of the present invention.

Figure 6:
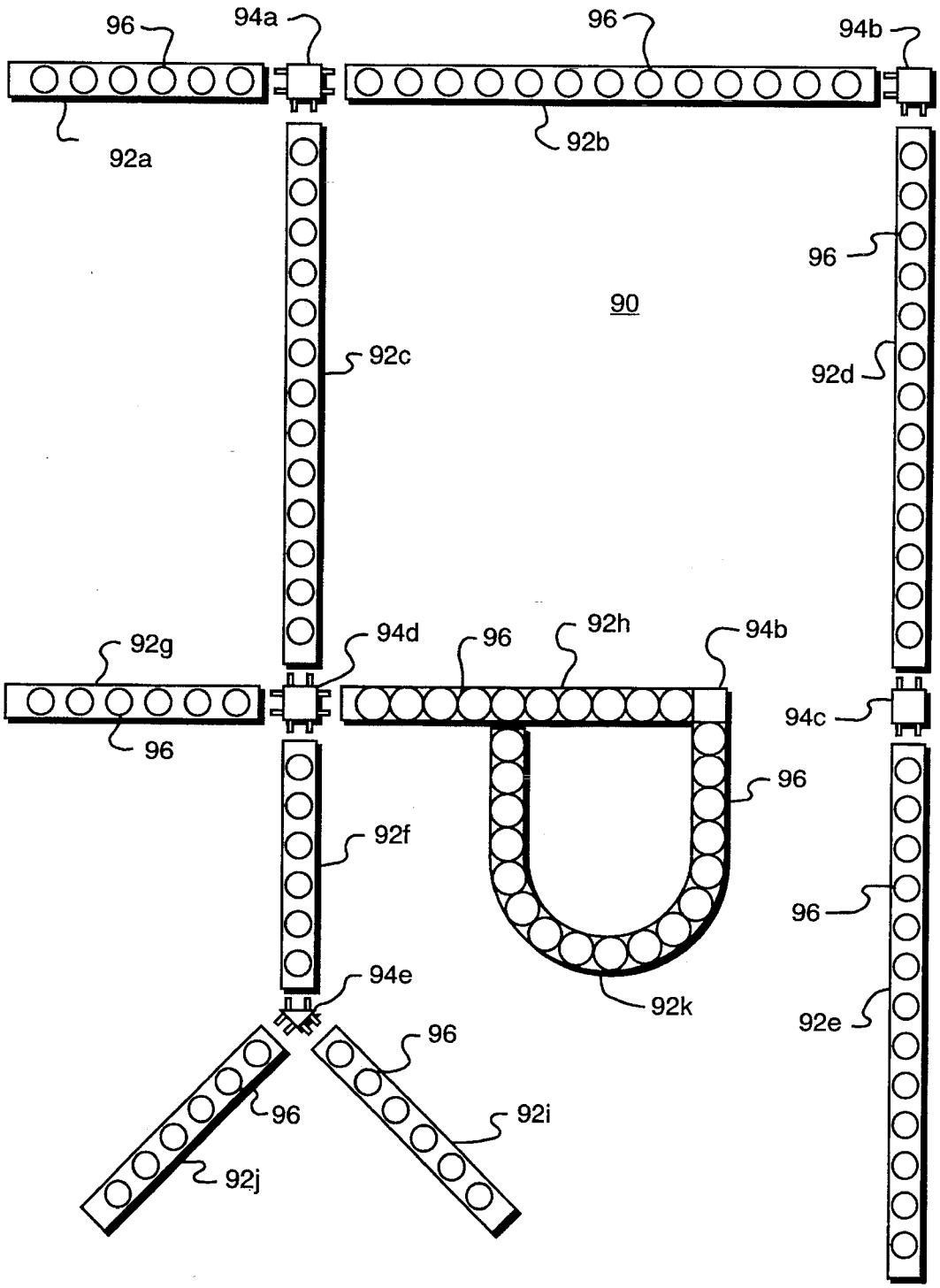
FIG. 6 is a diagrammatical representation of the lighting system in accordance with the present invention, illustrating the variety of shapes which may be formed.

A lighting system 90, FIG. 6, according to the present invention, is shown to illustrate the variety of patterns which may be made. A plurality of segments of light emissive material 92*a*–92*k*, cut from a continuous length of light emissive material, form different shapes depending on the different types of light emissive material couplers 94*a*–94*e* which interconnect each segment. Each segment of light emissive material includes a plurality of electrically coupled light emissive devices 96.

For example, coupling segments 92*a*, 92*b* and 92*c* with a "tee" shaped coupler 94*a* provides a configuration in the shape of the letter "T" Coupling segments 92*b*, 92*d* with coupler 94*b* forms a configuration in the shape of a right angle. Coupling segments 92*d*, 92*e* with straight coupler 94*c* provides a straight line of light emissive devices.

Similarly, coupling segments 92*c*, 92*f*, 92*g* and 92*h* with a four-way coupler 94*d* provides a four-way configuration. Segments 92*f*, 92*i*, and 92*j* coupled with "Y" coupler 94*e* provides a "Y" shaped configuration.

As a further example of the variety of shapes possible, coupling segments 92*h* and 92*k* with a right angle coupler 94*b* may provide a configuration in the shape of the letter "P". By utilizing the flexibility inherent in the electrical conductors included in each segment of light emissive material and in the mylar construction of the material, segment 92*k* may be bent to form the top portion of the letter "P", as shown. Those skilled in the art will recognize the multitude of shapes possible for lighting systems as illustrated in FIG. 5.

Figure 7:
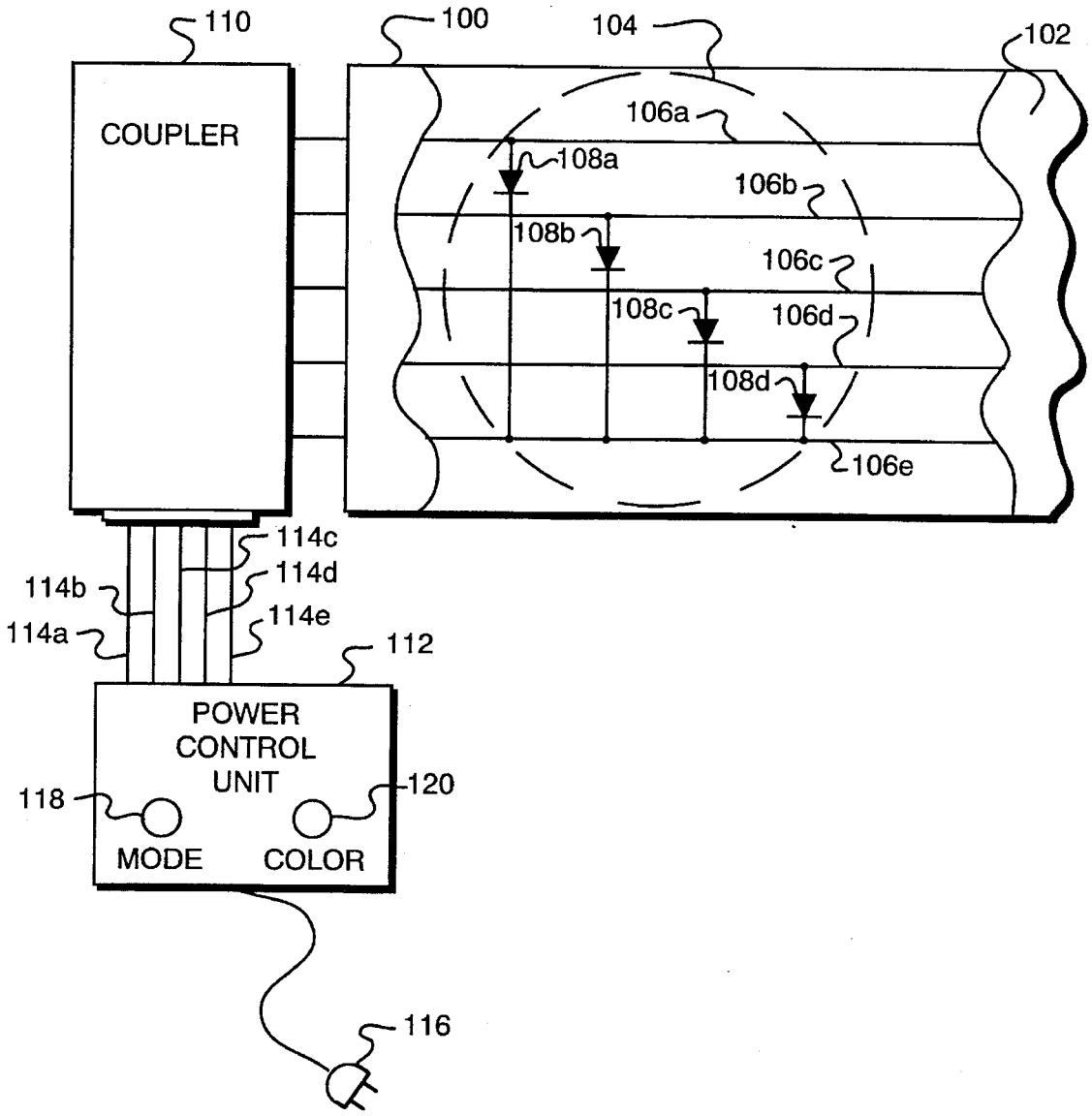
FIG. 7 is a cut-away view of a segment of light emissive material comprising five electrical conductors, wherein four light emissive devices are coupled to the five electrical conductors under one lens.

An alternative embodiment of a segment of light emissive material 100 is shown in FIG. 7. A cut away view of segment 100, with lens 104 and a portion of the top, transparent, mylar sheet 102 removed, exposes five electrical conductors 106*a*–106*e*. Further, four light emissive devices 108*a*–108*d* are mounted beneath lens 104 and coupled to the five electrical conductors 106*a*–106*c*.

Light emitter device 108*a* is shown coupled to the positive electrical conductor 106*a* and negative electrical conductor 106*e*; light emitter device 108*b* is shown coupled to the positive electrical conductor 106*b* and negative electrical conductor 106*e*; light emitter device 108*c* is shown coupled to positive electrical conductor 106*c* and negative electrical conductor 106*e*; and light emitter device 108*d* is shown coupled to positive electrical conductor 106*d* and negative electrical conductor 106*e*.

As seen in this embodiment, four light emitting devices 108*a*–108*d* may be attached to the segment of light emissive material 100 under one lens 104. The four light emissive devices 108*a*–108*d* may all be the same color, thereby increasing the brightness of the emitted light from the light emissive devices 108*a*–108*d*. Alternatively, the four light emissive devices 108*a*–108*d* may consist of the four primary colors, red, amber, green and blue, whereby, when used in combination, may produce emitted light of any color in the full color spectrum.

Segment 100 is coupled to light emissive material coupler 110, as described above in conjunction with FIG. 4, with the exception that coupler 110 comprises five interconnecting electrical conductors for interfacing with the five electrical conductors 106*a*–106*e* of segment 100. Coupler 110 is coupled to electrical power control unit 112 by means of five electrical conductors 114*a*–114*e*, such as individual wires, 5 conductor cable, or other similar means.

Power control unit 112 controlled by a microprocessor or equivalent electronics comprises a lighting sequence controller selector 118, alternatively referred to as a mode function, and a color selector 120. Power control unit 112 is coupled to an external source of power such as a typical 110 AC outlet by means of electrical plug 116.

The mode selector 118 controls the duration of the lighting sequence for each of the light emissive devices thereby providing sequences such as solid on, chase, flash, intermittent flash, twinkle, fade on/off, or visual response.

The color selector 120 is used concurrently with mode selector 118 to select the color of emitted light from the light emissive devices 108*a*–108*d*. By providing power to one of the electrical conductors 114*a*–114*e*, power is transmitted through coupler 110 to the respective conductors 106*a*–106*e*, thereby providing power to one of the light emissive devices 108*a*–108*d*. To obtain a color from a combination of primary colors, at least two of the electrical conductors 114*a*–114*d* in combination with negative electrical conductor 114*e* are supplied power, thereby supplying power to a combination of light emissive devices 108*a*–108*d* and producing the desired color.

Further, lens 104 may be clear or colored, depending on the desired color of emitted light from the light emissive devices 108*a*–108*d*.

Figure 8:
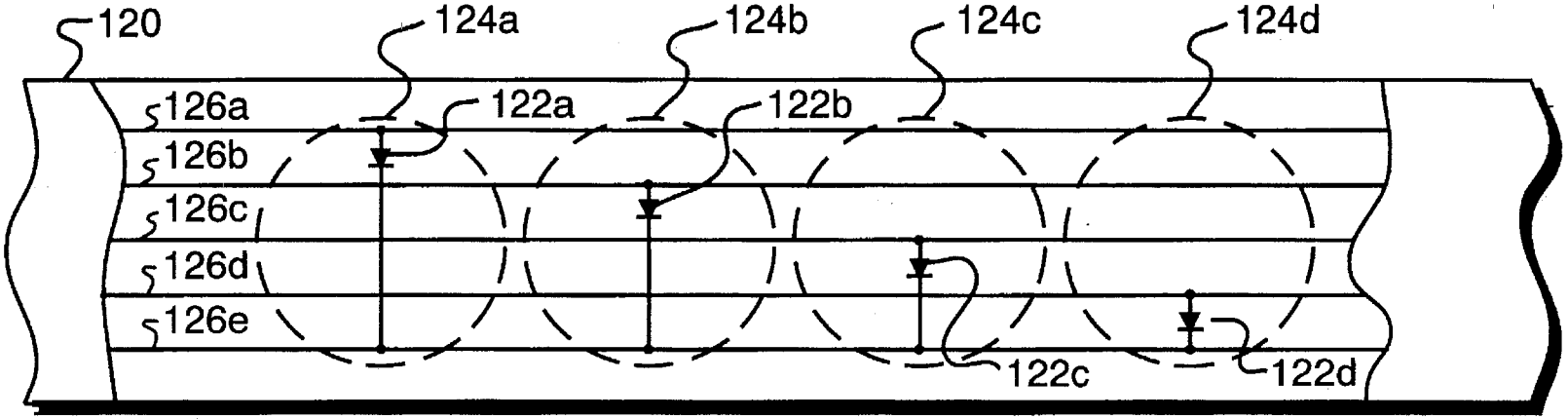
FIG. 8 is a cut-away view of the segment of FIG. 5 wherein each of the four light emissive devices are shown coupled to the five electrical conductors under individual lenses.

In an alternative embodiment, a segment of light emissive material 120, FIG. 8, comprises four light emissive devices 122*a*–122*d* each light emissive device covered by a separate lens 124*a*–124*d*. Each light emissive device 122*a*–122*d* may be of the same color, or may be of different colors. By coupling the four light emissive devices 122*a*–122*d* to separate electrical conductors 126*a*–126*e*, and providing intermittent power to each electrical conductor 126*a*–126*e* by means of control unit 112, the differently colored light emissive devices 124*a*–124*d* will flash alternately as directed by the controller 112. Those skilled in the art will recognize the variety of visual effects possible by coupling multiple light emissive devices under one lens or coupling individual light emissive devices under one lens and providing various lighting sequences to each electrical conductor, as mentioned above in conjunction with FIG. 7.

Modifications and substitutions by one of ordinary skill in the art are considered to be within the scope of the present invention which is not to be limited except by the claims which follow.

What is claimed is:

1. A flexible, self-adhesive, lighting system, comprising:

a continuous length of flexible, self-adhesive, light foot-emissive material adapted to be cut at any location into at least first and second light emissive segments, said continuous length of flexible, self-adhesive, light emissive material including at least first and second electrical conductors and a plurality of light emissive devices electrically coupled to said at least first and second electrical conductors;

at least a first light emissive material coupler, for coupling said at least first and second electrical conductors in one of said at least first and second light emissive segments to a source of electrical power, wherein said at least first and second electrical conductors are adapted to conduct electrical power from said source of electrical power to said plurality of light emissive devices; and at least a second light emissive material coupler, for mechanically and electrically coupling said at least first and second light emissive segments together, wherein said second light emissive coupler includes a plurality of conductor engaging elements, for piercing said at least first and second light emissive segments to contact said at least first and second electrical conductors within said at least first and second light emissive segments, and includes at least first and second interconnecting electrical conductors, for providing a continuous flow of electrical power from said first electrical conductor of said first light emissive segment to said first electrical conductor of said second light emissive segment and from said second electrical conductor of said first light emissive segment to said second electrical conductor of said second light emissive segment.

2. The system of claim 1, further including an adhesive strip coupled to a bottom surface of said light emissive material.

3. The system of claim 1 wherein said first segment includes a colored lens covering each of said plurality of electrically coupled light emissive deices, for changing a color of light emitted by said light emissive device.

4. The system of claim 1, wherein said first segment includes a clear lens covering each of said plurality of electrically coupled light emissive devices.

5. The system of claim 1, wherein said second electrical coupler includes a "T" shaped coupler, for electrically coupling said at least first and second segments into a "T" shaped configuration.

6. The system of claim 1, wherein said second electrical coupler includes a "Y" shaped coupler, for electrically coupling said at least first and second segments into a "Y" shaped configuration.

7. The system of claim 1, wherein said second electrical coupler includes a right angle coupler, for electrically coupling said at least first and second segments into a right angle configuration.

8. The system of claim 1, wherein each of said first and second electrical conductor comprises a copper strip.

9. The system of claim 1, wherein each of said first and second electrical conductor comprises a strip of braided metallic fabric.

10. A flexible, self-adhesive, lighting system, comprising:

a continuous length of flexible, self-adhesive, light emissive material adapted to be cut at any location along said continuous length of flexible, self-adhesive, light emissive material into at least a first light emissive segment;

said continuous length of flexible, self-adhesive, light emissive material including at least one negative electrical conductor and at least two positive electrical conductors and a plurality of groups of light emissive devices, each light emissive device in a group of light emissive devices being electrically coupled to said at least one negative electrical conductor and one of said at least two positive electrical conductors; said continuous length of flexible, self-adhesive, light emissive material further including a plurality of lenses, each lens of said plurality of lenses covering a respective group of light emissive devices; and at least a first light emissive coupler, for electrically coupling said first light emissive segment to a source of power.

11. The system of claim 10, further comprising an electrical power control unit, coupled between said source of electrical power and said first light emissive material coupler, for providing intermittent electrical power to one of said at least two positive conductors, for lighting selected light emissive devices electrically coupled to said one of said at least two positive conductors in each group of light emissive devices.

12. The system of claim 11, wherein said electrical power control unit includes a color selector, for selecting a color of light emitted by selected light emissive devices in each group of light emissive devices.

13. The system of claim 11, wherein said electrical power control unit includes a lighting sequence controller, for controlling the duration of lighting and sequence of lighting of each of said plurality of electrically coupled light emissive devices.

14. The system of claim 10, wherein each light emissive device in each group of light emissive devices covered by said lens differ in color with respect to each other light emissive device in each group of light emissive devices.

* * * * *